United States Patent [19]

Allen et al.

[11] 4,236,056

[45] Nov. 25, 1980

[54] MICROWAVE HEATER

[76] Inventors: Donald D. Allen, 2206 Cummings, Flint, Mich. 48503; Earl D. Allen, R.R. #1 Box 133M, Cabot, Ark. 72023

[21] Appl. No.: 7,164

[22] Filed: Jan. 29, 1979

[51] Int. Cl.[3] ..... H05B 6/78

[52] U.S. Cl. ..... 219/10.55 A; 219/10.55 R; 219/10.55 F

[58] Field of Search ..... 219/10.55 R, 10.55 A, 219/10.55 M, 10.55 F, 365, 341, 296; 126/376, 344, 361, 362; 165/106, 177

[56] References Cited

U.S. PATENT DOCUMENTS

| | | | |
|---|---|---|---|
| 2,978,562 | 4/1961 | Fox | 219/10.55 R |
| 3,778,578 | 12/1973 | Long et al. | 219/10.55 A |
| 3,891,817 | 6/1975 | Brown | 219/10.55 R |
| 3,920,945 | 11/1975 | Smith et al. | 219/10.55 R |
| 4,029,927 | 6/1977 | McMillan | 219/10.55 R |
| 4,114,011 | 9/1978 | Stubbs | 219/10.55 R |
| 4,114,012 | 9/1978 | Moen, et al. | 219/10.55 R |
| 4,152,567 | 5/1979 | Mayfield | 219/10.55 R |

*Primary Examiner*—Arthur T. Grimley
*Attorney, Agent, or Firm*—Gifford, VanOphem, Sheridan & Sprinkle

[57] ABSTRACT

A microwave heater is provided and comprises a tank having a plurality of fluid conduits disposed therein and communicating with a fluid inlet and a fluid outlet. Each fluid conduit comprises a plastic tube with an elongated metal core disposed therein to form an annular flow chamber within the tube. The inlet of a fluid transfer system is coupled to the outlet from the tank while a source of relatively cool fluid is connected to the tank inlet. A microwave generator is operatively coupled to the tank to generate microwave energy throughout the tank in order to heat the water and metal cores within the fluid conduits.

6 Claims, 4 Drawing Figures

MICROWAVE HEATER

BACKGROUND OF THE INVENTION

I. Field of the Invention

The present invention relates generally to water heaters and, more particularly, to a microwave water heater.

II. Description of the Prior Art

Water heaters of the type commonly found in homes, apartment buildings, office buildings and other types of building constructions typically include a water tank having an outlet fluidly coupled to a fluid conduit system extending throughout the building construction. The tank also includes a fluid inlet coupled to a source of relatively cool water. In hot water heaters of the type used to provide running hot water in bathrooms, sinks and the like, the water pressure from the source is normally sufficient to establish fluid flow through the tank and into the fluid conduit system. Conversely, a pump is typically employed to establish fluid flow through the tank and fluid conduit system where the hot water system is closed, i.e., where the outlet from the fluid conduit system is coupled to the inlet of the tank. As is well known in the art, such closed hot water systems are used in hot water space heating systems. Previously, both natural gas and electrical resistance heating have been used as the heating means for heating the water in the water tank. Both of these heating means, however, are disadvantageous for a number of reasons.

First, both natural gas and electrical resistance heating are disadvantageous in that the heating of the water within the water tank is localized at either the flame or the electrical resistance coil, respectively. Such localized heating results in uneven temperature throughout the water in the water tank which is inefficient and results in energy losses. Although some of the disadvantages of these previously-known heaters have been overcome by microwave water heaters, these previously-known microwave heaters have also suffered several disadvantages. A chamber microwave heater such as that disclosed in U.S. Pat. No. 4,029,927 is disadvantageous in that the water is unevenly heated within the tank since the length of time in which the water is contained within the tank is not constant for all of the fluid entering the inlet.

Moreover, even in conventional water heaters wherein a tubing coil within the heating chamber prolongs the period in which the fluid is acted upon by the heating medium, such as disclosed in U.S. Pat. No. 3,778,578, a portion of the heat energy is not transferred to the fluid in the tubing but rather is wastefully imparted to the ambient air around the tubing and the tubing body itself. In addition, the heating medium must be constantly activated in order to transfer heat energy to the water. Thus, the heater is costly to operate.

A still further disadvantage of previously known natural gas and electrical water heaters is that the natural gas burner or the electrical resistance coil, respectively, is turned either completely on or completely off regardless of the amount of heating required by the water in the tank. This on-off operation of the previous-known water heaters also results in the inefficient use of energy.

SUMMARY OF THE PRESENT INVENTION

The present invention overcomes the above-mentioned disadvantages of the previously-known water heaters by providing a microwave water heater having a plurality of fluid manifolds each having an energy-absorbing core which conducts heat energy to the fluid flowing through the manifolds, and prolongs the length of time in which the water absorbs heat energy.

In brief, the water heater according to the present invention comprises a tank having a fluid outlet coupled to a fluid transfer system such as a space heating system in a home and a fluid inlet coupled to an appropriate water source. Fluid flow from the water source, through the fluid conduits in the tank and into the fluid transfer system is accomplished by conventional pump means for a closed hot water system or by the fluid pressure from the water source for an open water system, i.e., where the water heater supplies running water to faucets, bathrooms, or the like.

A microwave generator is operatively coupled to the tank so that the microwave generator radiates electromagnetic energy throughout the interior of the tank. Upon the passage of the electromagnetic energy through the tank, water within the tank absorbs the energy and becomes heated. The water is contained in the tank by a plurality of fluid manifolds within the interior of the water tank. Each fluid manifold comprises a plurality of conduits and each conduit has a metal core disposed coaxially through it. The cores not only inhibit or slow down the flow of fluid through the conduit but also absorb microwave energy and transfer it by conduction to the fluid as heat energy.

Thus, since the length of time in which the fluid remains in contact with the microwave radiation is substantially the same for all the fluid, all of the fluid entering the outlet is efficiently heated to substantially the same temperature. Moreover, since the metal cores absorb the microwave energy and convert it to heat, the fluid in the conduit continues to be heated by the core even after the microwave generator is turned off, thus conserving more energy. In addition, the metal absorbs more microwave energy faster than that fluid and thus tends to decrease energy losses through the side of the tank as compared to previously-known microwave heaters wherein the fluid is in contact with the tank walls.

A primary advantage of the microwave water heater of the present invention is that the microwave generator can generate microwave energy substantially uniformly throughout the entire water tank. This in turn permits the water within the tank to be substantially uniformly heated.

The provision of cores within the fluid conduits of the manifolds slows down the flow of fluid through the heater tank to ensure that the fluid has absorbed a sufficient amount of energy before its discharge from the tank. Moreover, the cores as well as the fluid itself absorb the microwave energy and convert it into heat energy. Thus, even when the microwave generator has been shut off, the heat from the cores is conducted to the fluid within the conduits to further heat the fluid while conserving energy by eliminating the need for a constantly operating microwave source to heat the water within the tank.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DETAILED DESCRIPTION OF THE PRESENT INVENTION

Figure 1:
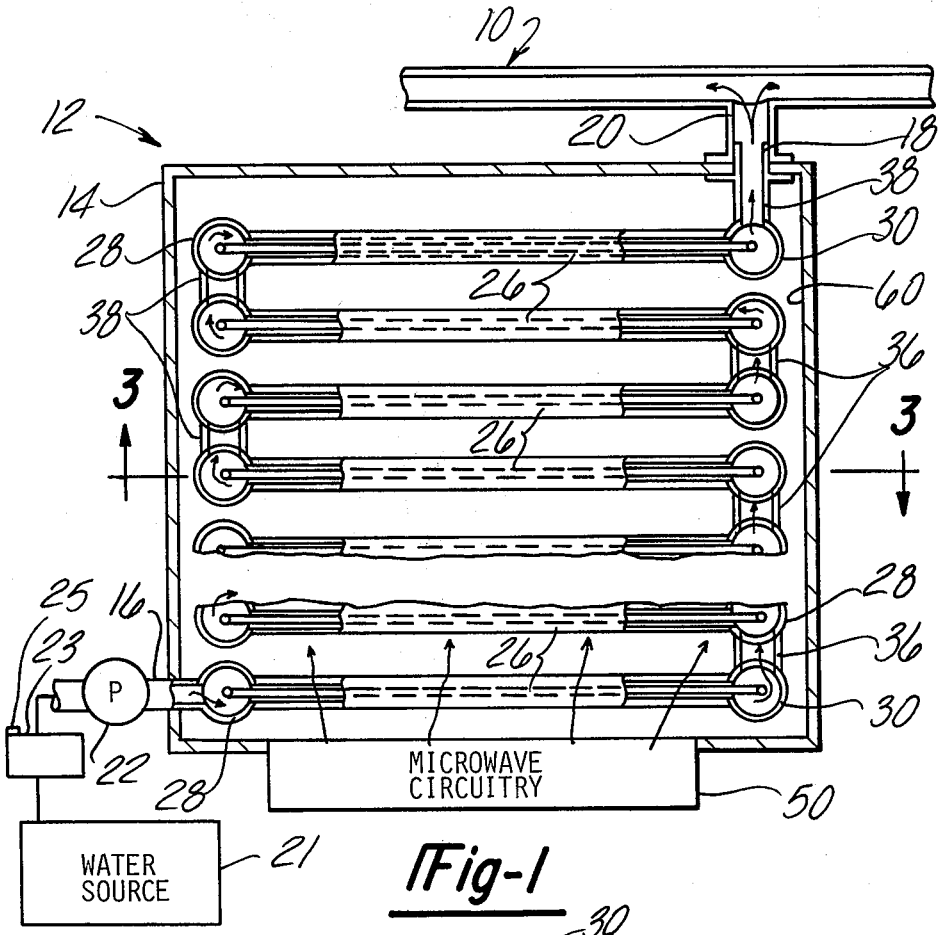
FIG. 1 is a fragmentary sectional side plan view illustrating a water heater according to the present invention coupled to a water heating system.

With reference first to FIG. 1 a hot water system 10 is thereshown employing a water heater 12 according to the present invention. The water heater 12 includes an outer housing 14 having an inlet 16 and an outlet 18. The outlet 18 is coupled to a fluid transfer system 20 which extends through a building construction (not shown) while the inlet 16 is coupled to a source 21 of fluid pressure. In the water system 10 illustrated in FIG. 1, the water system can be a closed system so that the source of fluid pressure comprises the return from the fluid transfer system 20 in combination with a fluid pump 22. An expansion tank 23 and water fill 25 (illustrated diagrammatically) are fluidly coupled to the water system 10 in the conventional fashion.

Figure 2:
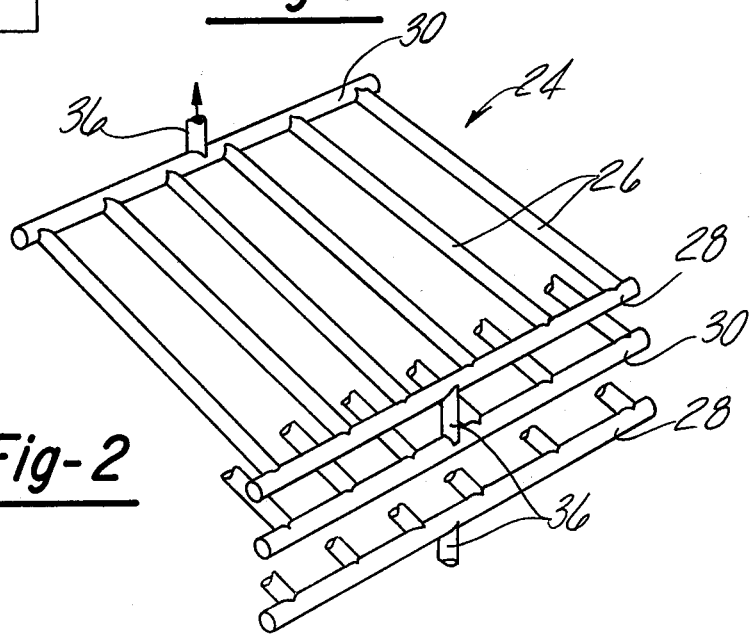
FIG. 2 is a fragmentary perspective view illustrating the fluid manifolds of the water heater according to the present invention.
Figure 3:
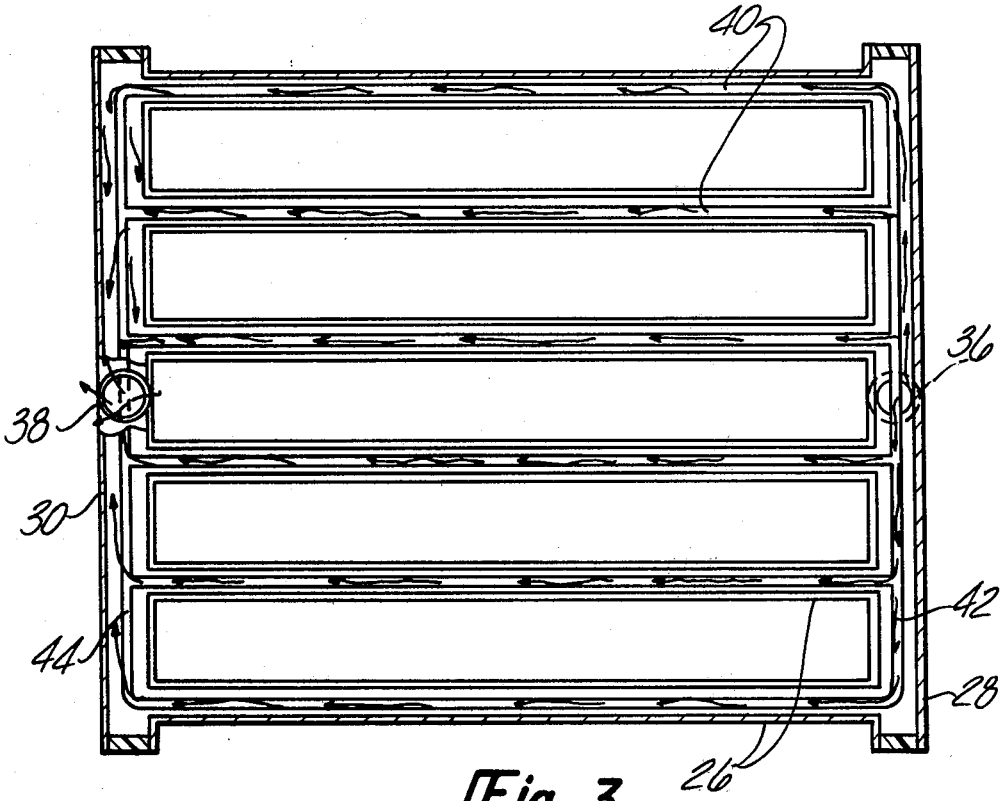
FIG. 3 is a top plan view of a single manifold of the water heater shown in FIG. 1.

With reference now to FIGS. 1 and 2, the housing 14, unlike the previously-known microwave water heaters that heat water contained within the interior 30 of the housing, contains a plurality of fluid manifolds 24 connecting the inlet 16 to the outlet 18. The interior of the housing is preferably lined with a microwave reflective material to reduce energy losses and thereby increase the efficiency of the heater. Each fluid manifold 24 further comprises a plurality of spaced and parallel conduits 26 fluidly connected to a large diameter transfer conduit 28 and 30 at each end. The conduits 26 are preferably made of a nonmetallic material, such as plastic, to minimize their absorbtion of microwave energy. A plurality of such manifolds 24 are supported one above the other (best shown in FIG. 1) and each manifold 24 is fluidly connected to its adjacent manifolds by a fluid conduit riser 36 or 38 secured to and fluidly connected with one of the transfer conduits 28 or 30 of the manifold 24. The risers 36, 38 are positioned so that the risers connecting consecutive manifolds are alternately arranged at opposite sides of the housing 14. Therefore, the flow through all conduits in a single manifold is in the same direction, while the fluid flow through the conduits of the adjacent manifolds is in the opposite direction.

Although the number of manifolds needed depends upon the requirements of the system to which the heater is connected, the preferred embodiment shown in the drawing contains ten fluid manifolds, each manifold 24 having six conduits 26 and two transfer conduits 28 and 30. The lowermost manifold 24 is connected via its transfer conduit 28 to the housing inlet 16. Similarly, the uppermost manifold 24 is connected via its transfer conduit 30 and riser 36 to the housing outlet 18.

Figure 4:
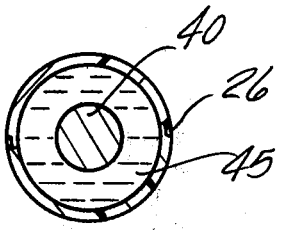
FIG. 4 is a sectional view of a single conduit of the manifold shown in FIG. 3.

Each of the conduits 26 and the transfer conduits 28 and 30 has a metal core 40, 42, and 44, respectively, coaxially positioned through it to form an annular flow passage 45 through the conduit (FIG. 4). The length of the cores is substantially the same as the length of the conduits so that the fluid flowing through the conduit is in substantially continuous contact with the metal core. Preferably, the metal cores 40, 42, and 44 are secured together and are made of noncorrosive steel.

The cores 40, 42, and 44 restrict the flow of fluid through the conduits 26, 28, and 30 so that the fluid remains subjected to the microwave radiation for an extended period as will become shortly apparent. In addition, the cores absorb microwave energy and convert it to heat which is then transferred by conduction to the water flowing past the core. Thus, microwave energy which would normally be reflected and lost from the system is instead retained and stored in the metal cores. Consequently, the microwave generator need not be continuously activated to heat the fluid flowing through the heater. Such action reduces the operating costs of the device and simultaneously increases the efficiency of the heater.

A microwave generator 50 is secured to the housing 14 and, when activated, radiates microwave energy into the interior of the tank 14. In doing so, the water contained within manifolds 24 in the interior of the tank 14 absorbs the microwave energy and becomes heated in the well-known fashion.

Preferably, the inside of the tank housing 14 is coated with a microwave reflector material 60 which reflects the microwave energy impinging thereon back through the water tank 14. The coating 60 enables maximum absorption of the microwave energy by the water and metal cores in the tank housing 14 and simultaneously prevents the undesirable emission of microwave energy externally of the housing 28.

Appropriate control means (not shown) are employed to activate the microwave generator means 50 when required to heat the water within the tank housing 14. Moreover, since the microwave energy uniformly heats the water, energy losses and inefficiencies are maintained at a minimum. In addition, unlike previously-known microwave water heaters which use baffles in the tank interior to reflect microwaves and eliminate energy losses, the metal cores 40, 42 and 44 of the present invention absorb some of the microwave energy and convert it to heat energy. A portion of the heat energy absorbed by the cores is then transferred by conduction to the fluid flowing through the conduits while the remaining portion remains stored in the metal cores. The stored portion of the energy will be transferred by conduction to the fluid in the conduit after the microwave generator 50 has been deactivated. Thus the microwave generator need not be continuously activated to heat the fluid in the heater of the present invention.

It can, therefore, be seen that the water heater 12 according to the present invention provides a novel means whereby the water is heated directly by microwave energy as well as by conduction through the metal cores in a manner which has been heretofore unknown. Moreover, it will be appreciated that since the microwaves are generated throughout the entire interior of the tank housing 14, the water within the tank 14 is heated substantially uniformly thereby overcoming the inefficiencies of the previously-known natural gas and electrical water heaters. The novel energy absorption and transfer means, i.e., the manifolds having the metal cores, of the present invention overcome the inefficiencies of previously-known microwave heaters.

Although the fluid which is heated by the heater has been described as water, it is to be understood that the present invention is not so limited but is applicable to a microwave heater for any fluid and fluid system.

Having described our invention, however, many modifications thereto will become apparent to those skilled in the art to which it pertains without deviation from the spirit of the invention as defined by the scope of the appended claims.

We claim:

1. A fluid heater comprising, a housing defining a chamber therein, fluid passage means disposed within said chamber and having an inlet and an outlet which are in fluid communication with the exterior of the housing, said fluid passage means further comprising a plurality of first conduits, each first conduit having a metal core axially disposed therein to form an annular flow chamber between each core and each conduit; and means for selectively radiating microwave energy throughout the chamber whereby the fluid in the conduits as well as the metal cores absorb the energy and are heated.

2. The invention as defined in claim 1 wherein said fluid passage means further comprises at least one manifold having a plurality of said conduits which are spaced apart and substantially parallel to each other, each conduit being fluidly connected to larger diameter transfer conduit at each axial end.

3. The invention as defined in claim 2 wherein said fluid passage means comprises a plurality of said manifolds, the planes of said manifolds being spaced apart from but substantially parallel to each other, and a plurality of conduit risers for fluidly connecting the manifolds together.

4. The invention as defined in claim 3 wherein said risers are alternately connected at opposite ends of the manifolds so that fluid passing through the conduits of a single manifold flows in one direction while the flow in the conduits of the adjacent manifold is in the opposite direction.

5. The invention as defined in claim 1 wherein said cores are made of steel.

6. The invention as defined in claim 1 wherein said conduit is made of a plastic material.

* * * * *